United States Patent [19]

Wilfong, Jr. et al.

[11] Patent Number: 4,930,385

[45] Date of Patent: Jun. 5, 1990

[54] DISPENSING NOZZLE FOR PLASTIC BAGS

[75] Inventors: Harry B. Wilfong, Jr.; Edwin W. Haenni, both of Hartsville, S.C.

[73] Assignee: Sonoco Products Company, Hartsville, S.C.

[21] Appl. No.: 331,962

[22] Filed: Apr. 3, 1989

[51] Int. Cl.[5] ..... B26F 3/02

[52] U.S. Cl. ..... 225/106; 221/63; 225/52

[58] Field of Search ..... 225/52, 106; 221/34, 221/63

[56] References Cited

U.S. PATENT DOCUMENTS

| | | | |
|---|---|---|---|
| 441,669 | 12/1880 | Jones | 225/38 |
| 3,002,668 | 10/1961 | Castelli | 225/52 |
| 3,269,593 | 8/1966 | Lodewick et al. | 221/63 |
| 3,771,700 | 11/1973 | Garr | 225/39 |
| 3,868,052 | 2/1975 | Rockefeller | 225/106 |
| 3,958,768 | 5/1976 | Fairbanks | 206/409 X |
| 3,982,659 | 9/1976 | Ross | 225/106 |
| 3,986,479 | 10/1976 | Bonk | 225/106 X |
| 3,994,417 | 11/1976 | Boedecker | 221/48 |
| 4,181,218 | 1/1980 | Cox | 206/205 |
| 4,191,307 | 3/1980 | LeCaire, Jr. et al. | 221/45 |
| 4,289,262 | 9/1981 | Finkelstein | 225/106 |
| 4,526,291 | 7/1985 | Margulies | 221/63 |
| 4,648,530 | 3/1987 | Granger | 221/34 |
| 4,793,539 | 12/1988 | Haenni et al. | 225/106 |

FOREIGN PATENT DOCUMENTS

| | | |
|---|---|---|
| 1107603 | 4/1975 | Japan . |
| 1325923 | 8/1973 | United Kingdom . |

*Primary Examiner*—Hien H. Phan

*Attorney, Agent, or Firm*—Bell, Seltzer, Park & Gibson

[57] ABSTRACT

A dispensing nozzle for serially dispensing flexible plastic bags is disclosed, and which includes a generally circular plate and a depending tubular mounting sleeve. Two elongate zigzag slots of differing size extend through the plate, and a thread-up opening is positioned at each end of each slot. Each thread-up opening is of a size to permit the free end of the leading bag of a package of bags to be manually threaded therethrough and such that the bag may then be moved into the slot. The differing sizes of the two slots permits bags of differing size to be efficiently received in respective ones of the slots. When the bag is pulled upwardly from its associated slot, its movement is resisted by the zigzag configuration of the slot, and the resistance facilitates the severance of the pulled bag from an immediately following bag joined thereto along a severance line. The bags may be withdrawn in either lateral direction with equally effective results.

12 Claims, 1 Drawing Sheet

DISPENSING NOZZLE FOR PLASTIC BAGS

FIELD OF THE INVENTION

The present invention relates to a dispensing nozzle adapted for serially dispensing flexible plastic bags from a package of bags which are joined along perforated severance lines.

BACKGROUND OF THE INVENTION

Commonly owned U.S. Pat. No. 4,793,539 to Haenni et al discloses a dispensing nozzle for serially dispensing plastic grocery bags or the like from a supply roll and wherein the supply roll is composed of bags which are serially joined along perforated severance lines. The nozzle disclosed in the Haenni et al patent includes a slot of zigzag configuration, together with a thread-up opening disposed along one side of the slot, and the nozzle is disclosed as being mounted in a bore in a grocery store checkout countertop, with the bag supply roll being mounted below the countertop. In use, the leading edge of the initial bag on the roll is manually threaded through the thread-up opening, and the leading edge is then grasp and moved laterally into the slot. Thereafter, the bags may be individually delivered by pulling the bags upwardly and laterally outwardly, and the zigzag slot exerts sufficient resistance so as to cause a severing of the leading bag from the immediately following bag along the perforated severance line.

While the dispensing nozzle disclosed in the above referenced Haenni et al patent represents a significant advance in the art, it possesses certain limitations in use. Specifically, the plastic bags may be withdrawn in only one lateral direction, i.e., in a direction away from the thread-up opening, since moving the bag laterally toward the thread-up opening will cause the bag to move into the opening, with the result that insufficient resistance is imported to the bag to effect the desired severance. Also, the nozzle is not adapted for bags of significantly different sizes, and a second nozzle having a different slot size or configuration may be required for larger or smaller bags.

It is accordingly an object of the present invention to provide a plastic bag dispensing nozzle which overcomes the limitations of the above described prior nozzle.

It is a more specific object of the present invention to provide a plastic bag dispensing nozzle which permits the bags to be withdrawn from the slot in either lateral direction with equal effectiveness, and which permits bags of varying size to be dispensed through a single nozzle.

SUMMARY OF THE INVENTION

These and other objects and advantages of the present invention are achieved in the embodiment illustrated herein by the provision of a dispensing nozzle which comprises a plate, at least one elongate slot extending through the plate, and with the slot being configured for resisting the free movement of bags therethrough. A thread-up opening means extends through the plate and communicates with one end of the elongate slot, the opening means including a generally circular portion of a size to permit the end of the leading bag of a package of bags to be manually threaded therethrough and such that the bag may then move into the slot. The configuration of the slot, which is preferably of zigzag configuration along its length, resists the free movement of a bag being pulled through the slot and the resistance facilitates the severance of the pulled bag from an immediately following bag joined thereto along the severance line.

In a preferred embodiment, the plate includes two generally parallel slots of differing lengths so as to efficiently accommodate bags of differing size. Also, a thread-up opening is preferably positioned at each end of each slot to facilitate tracking of the bags centrally within each slot.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
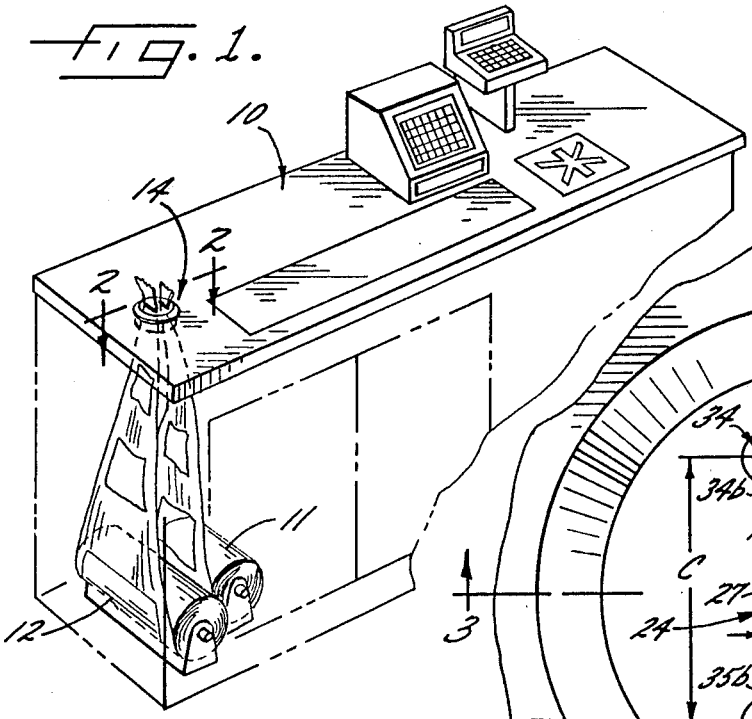
FIG. 1 is a perspective view of a grocery store checkout counter, and which mounts a bag dispensing nozzle in accordance with the present invention.
Figure 2:
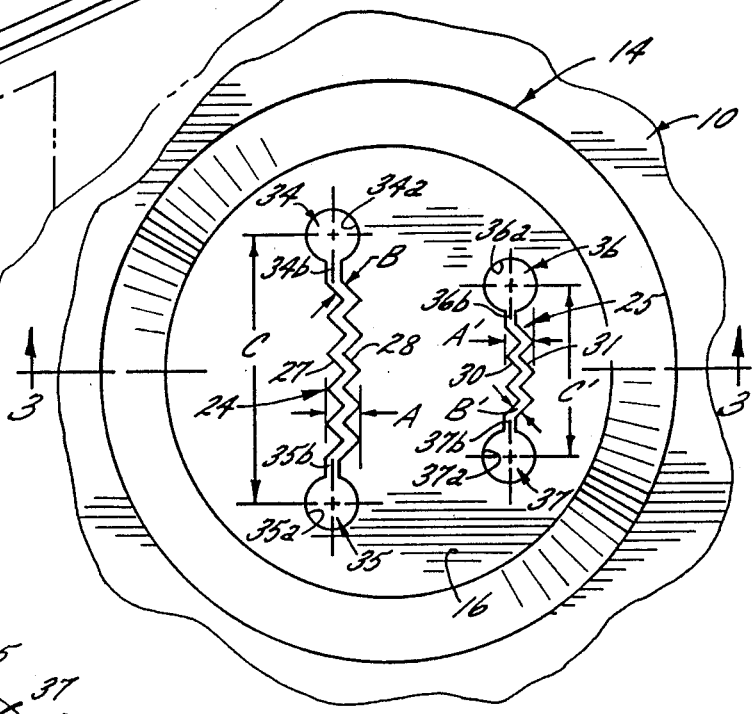
FIG. 2 is a top plan view of the nozzle.
Figure 4:
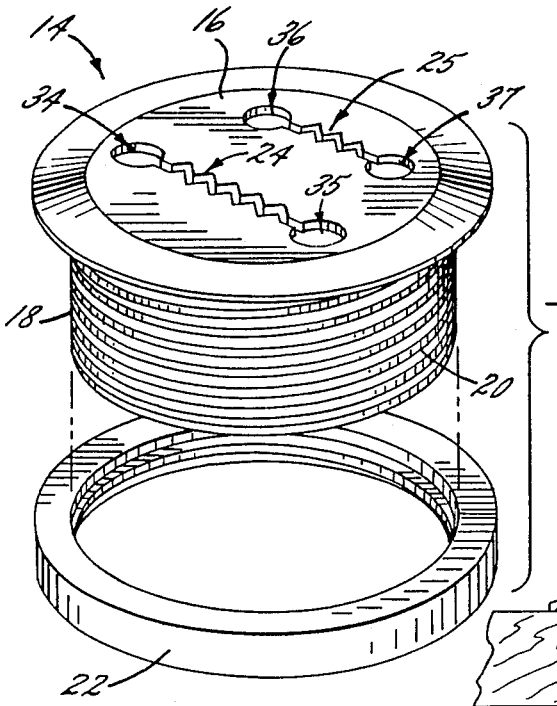
FIG. 4 is an exploded perspective view of the nozzle and its supporting unit.

Referring more particularly to the drawings, FIG. 1 illustrates a conventional grocery store checkout counter at 10, and which is adapted to selectively dispense plastic bags from each of two supply rolls 11, 12. As is conventional, the bags of each roll may be in the form of T-shirt or handle bags, with the bags being serially joined along transverse perforated severance lines. Also, in the illustrated embodiment, the bags of the roll 12 are larger than the bags of the roll 11.

In accordance with the present invention, a bag dispensing nozzle 14 is mounted in a bore 15 in the top of the counter 10, it being understood of course that the nozzle alternatively could be mounted in one of the vertical sides of the counter or in any suitable housing for the rolls of bags. In any event, the nozzle 14 is preferably of a molded rigid plastic construction, and it comprises a generally flat circular plate 16, and an integrally joined depending tubular sleeve 18 which is received in the bore 15. The plate 16 has a diameter greater than that of the sleeve 18, so as to define a peripheral flange which rests upon the upper surface of the counter 10. Also, the upper surface of the flange is bevelled about its periphery at 19 so as to define a feather edge at its juncture with the top of the counter, to thereby minimize disruption of the flat counter surface.

Figure 3:
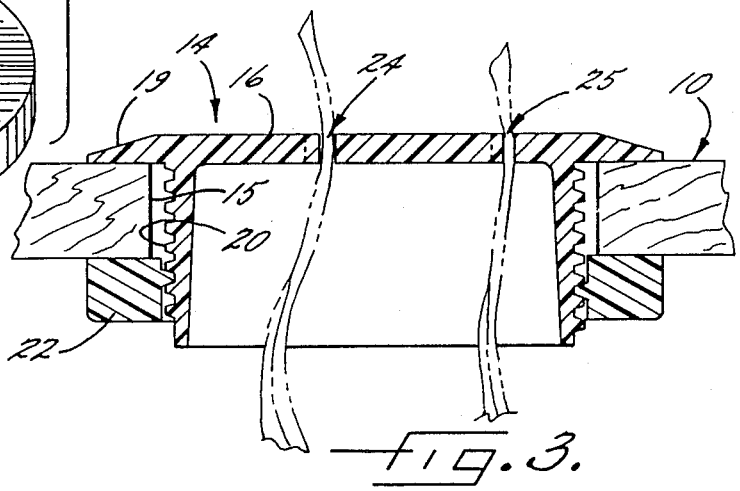
FIG. 3 is a sectional view of the nozzle taken substantially along the line 3—3 of FIG. 2.

To securely mount the nozzle 14 in the bore, the outer surface of the sleeve 18 is provided with a helical thread 20, and a threaded nut 22 is provided which is sized to threadly engage the thread on the sleeve, and such that the nut 22 engages the under surface of the counter 10 as seen in FIG. 3.

The nozzle 14 of the present invention also includes two elongate slots 24, 25 extending through the plate, and at locations so as to communicate with the interior passage of the sleeve 18. The two slots are parallel to each other, and each slot is of zigzag configuration along its longitudinal length. More particularly, the slot 24 defines opposing spaced apart side edges 27, 28 of sawtooth like configuration and such that each of the side edges 27, 28 comprises alternating V-shaped projections and recesses, and with the projections of each side edge being laterally aligned with the recesses of the opposite side edge. Similarly, the slot 25 defines opposing spaced apart edges 30, 31 comprising alternating projections and recesses of like configuration. The slot 24 is of longer length than the slot 25 and the separation of the edges 27, 28 of the slot 24 is slightly greater than the separation of the edges 30, 31 of the slot 25.

The nozzle 14 further comprises a pair of thread-up opening means 34, 35 extending through the plate and communicating with respective ends of the slot 24, and a second pair of thread-up opening means 36, 37 extending through the plate and communicating with respective ends of the slot 25. More particularly, each of the opening means 34–37 comprises a generally circular portion **34*a*, 35*a*, 36*a*, 37*a*, and a radial segment 34*b*, 35*b*, 36*b*, 37*b* of a width corresponding to the separation of the edges of the associated slot. Also, each radial segment 34*b*–37*b*** extends longitudinally from the end of the associated slot to the circular portion. The diameter of the circular portion of each opening means is preferably greater than the lateral distance A or A′ between the recesses of the associated slot, but not greater than about twice the lateral distance A or A′ between the recesses.

As a specific non-limiting example, the plate 16 has an outer diameter of about 4.0 inches, and the sleeve 18 has an inside diameter of about 2.5 inches. The separation B of the edges 27, 28 of the slot 24 is about 1/16 inches, and the separation B′ of the edges 30, 31 of the slot 25 is about 3/64 inches. Further, the lateral distance A between the recesses of the opposing side edges 27, 28 of the slot 24 is about 7/32 inches, whereas the corresponding distance A′ for the slot 25 is about 5/32 inches. Still further, the circular portions **34*a*–37*a* of the opening means are each about $\frac{3}{8}$ inches in diameter, and the centers of the circular portions 34*a*, 35*a* associated with the slot 24 are longitudinally separated about $1\frac{7}{8}$ inches as indicated at C, and the centers of the circular portions 36*a*, 37*a* associated with the slot 25** are longitudinally separated about 1 3/16 inches as indicated at C′.

In use, the leading bag from the roll 11 is manually threaded through either one of the circular portions **36*a*, 37*a* associated with the slot 25 and then moved longitudinally through the radial segment 36*b* or 37*b* and into the slot. Similarly, the leading bag from the roll 12 is manually threaded through either one of the circular portions 34*a*, 35*a* associated with the slot 24** and then moved longitudinally into the slot. The bags from either roll may then be serially dispensed, by drawing the leading bag upwardly and laterally outwardly in either direction with respect to the associated slot. As the bag moves upwardly, the resistance imparted by the engagement of the projections of the slot with the moving bag resists the free movement of the bag, and this resistance facilitates the severance of the pulled bag from the immediately following bag joined thereto along the severance line. Complete separation does not normally occur until the leading portion of the following bag passes through the slot, and such that the following bag is then in position to be grasped and withdrawn in the same manner. The presence of a thread-up opening means at each end of each slot serves to facilitate the tracking of the bags centrally within each slot.

In the drawings and specification there have been set forth a preferred embodiment of the invention, and although specific terms are employed they are used in a generic and descriptive sense only and not for purposes of limitation.

That which is claimed is:

1. A dispensing nozzle adapted for serially dispensing flexible plastic bags or the like from a package of bags joined along perforated severance lines, and comprising a plate, at least one elongate slot extending through said plate, with said slot being configured for resisting the free movement of bags therethrough, and thread-up opening means extending through said plate and communicating with at least one end of said one elongate slot, said opening means including a generally circular portion of a size to permit the free end of the leading bag of a package of bags to be manually threaded therethrough and such that the bag may then be moved into said slot, and whereby the configuration of said slot resists the free movement of a bag being pulled through said slot and the resistance facilitates the severance of the pulled bag from an immediately following bag joined thereto along the severance line.

2. The dispensing nozzle as defined in claim 1 wherein said slot is of zigzag configuration along its length and defines opposing spaced apart side edges of sawtooth like configuration, and such that each edge comprises alternating V-shaped projections and recesses, and with the projections of each side edge being laterally aligned with the recesses of the opposite side edge.

3. The dispensing nozzle as defined in claim 2 wherein said circular portion of said opening means has a diameter greater than the lateral distance between the recesses of the opposing side edges.

4. The dispensing nozzle as defined in claim 3 wherein said circular portion of said opening means has a diameter not greater than about twice the lateral distance between the recesses of the opposing side edges.

5. The dispensing nozzle as defined in claim 1 further comprising a tubular sleeve defining a central passage, and wherein said plate transversely overlies one end of said passage and is integrally molded with said sleeve.

6. The dispensing nozzle as defined in claim 5 wherein said plate is of circular outline and includes a flange portion which extends outwardly beyond the periphery of said sleeve.

7. The dispensing nozzle as defined in claim 6 wherein said sleeve includes an external thread, and wherein said nozzle further comprises a threaded nut sized to threadedly engage said thread on said sleeve.

8. The dispensing nozzle as defined in claim 1 wherein said nozzle includes a second like thread-up opening means extending through said plate and communicating with the other end of said one elongate slot.

9. A dispensing nozzle adapted for serially dispensing flexible plastic bags or the like from each of two packages of bags joined along perforated severance lines, and comprising a generally flat plate, at least two elongate, generally parallel, and laterally spaced apart slots extending through said plate, with each of said slots being of zigzag configuration along its length and with one of said slots being longitudinally longer than the other of said slots, and thread-up opening means extending through said plate and communicating with at least one end of each of said slots, with each of said opening means including a generally circular portion of a size to permit the free end of the leading bag of a package of bags to be manually threaded therethrough and such that the bag may then be moved into said slot, and whereby the zigzag configuration of each slot resists the free movement of a bag being pulled therethrough and the resistance facilitates the severance of the pulled bag from an immediately following bag joined thereto along the severance line.

10. The dispensing nozzle as defined in claim 9 wherein each of said slots defines opposing spaced apart side edges of sawtooth-like configuration, and such that each side edge comprises alternating projections and recesses, and with said side edges of said one slot being separated a distance greater than the side edges of said other slot.

11. The dispensing nozzle as defined in claim 10 further comprising a second like thread-up openings means extending through said plate and communicating with the other end of each of said slots.

12. The dispensing nozzle as define in claim 11 wherein said circular portion of each of said openings means has a diameter of about 6/16 inches, and the separation of the side edges of each of said slots is between about 1/16 and 3/64 inches.

* * * * *

UNITED STATES PATENT AND TRADEMARK OFFICE

CERTIFICATE OF CORRECTION

PATENT NO. : 4,930,385

DATED : June 5, 1990

INVENTOR(S) : Harry B. Wilfong, Jr. and Edwin W. Haenni

It is certified that error appears in the above-identified patent and that said Letters Patent is hereby corrected as shown below:

IN THE CLAIMS:

Claim 11, line 5, "openings" should be -- opening --.

Claim 12, line 9, "openings" should be -- opening --.

Signed and Sealed this

Sixteenth Day of July, 1991

*Attest:*

HARRY F. MANBECK, JR.

*Attesting Officer*

*Commissioner of Patents and Trademarks*